United States Patent [19]

Garofalo

[11] 4,359,999

[45] Nov. 23, 1982

[54] SPEARGUN WITH TRIGGER MECHANISM FOR RELEASING A LINE TETHERED TO A SPEAR

[75] Inventor: Giovanni Garofalo, Rapallo, Italy

[73] Assignee: AMF Incorporated, White Plains, N.Y.

[21] Appl. No.: 225,154

[22] Filed: Jan. 15, 1981

[30] Foreign Application Priority Data

Jan. 18, 1980 [IT] Italy ..... 15111/80[U]

[51] Int. Cl.[3] ..... F41B 15/00

[52] U.S. Cl. ..... 124/80; 124/22

[58] Field of Search ..... 124/35 R, 80, 1, 26, 124/27, 83, 71, 73, 57, 36; 43/6

[56] References Cited

U.S. PATENT DOCUMENTS 3,585,979 6/1971 Hendricks ..... 124/35 R X

FOREIGN PATENT DOCUMENTS 888236 8/1943 France ..... 124/80

888345 9/1943 France ..... 124/80

*Primary Examiner*—Richard C. Pinkham

*Assistant Examiner*—William R. Browne

*Attorney, Agent, or Firm*—David E. Dougherty; Walter R. Pfluger

[57] ABSTRACT

A spear gun having a dog member is fulcrumed to a vertical pin carried by the trigger guard of the handgrip of an underwater gun. Said dog member is provided with sidewise outwardly projecting arm, and is further provided with an intermediate notch cooperating with the front edge of the lower end of the trigger, to lock said dog member into line retaining position whenever the trigger is in its rest position, and to unlock said dog member into line releasing position upon operation of the trigger. The dog member is cam shaped in proximity of said notch, and the said cam cooperates with the front edge on the trigger in order to automatically reset the dog member into its cocking or line retaining position after each shot.

3 Claims, 3 Drawing Figures

SPEARGUN WITH TRIGGER MECHANISM FOR RELEASING A LINE TETHERED TO A SPEAR

BACKGROUND AND SUMMARY OF THE INVENTION

This invention relates generally to the underwater guns, and more particularly to the line releasing devices for said guns, and it is its main object to provide a line releasing device for said guns which is very simple yet reliable in its operation. According to one aspect of the invention, the line releasing device includes a dog member, fulchrumed at one end around a vertical axis to the trigger guard of the gun, so as to rock in a horizontal plane, from a line retaining position to a line releasing position. The said dog member is provided with a sidewise outwardly projecting arm, to which the line may be releasably hooked. The central portion of said dog member is provided with a notch, which may be releasably engaged by the lower end of the trigger, so as to lock the dog into line retaining position, until the trigger is operated. In proximity of said notch, the dog member is cam shaped so that the trigger, whenever coming back to its rest position after firing, will automatically reset and lock the dog member into its line retaining position.

BRIEF DESCRIPTION OF THE DRAWINGS

Further features and advantages of the invention will appear from the following specification of one preferred embodiment of the invention, made with reference to the accompanying drawings, in which.

DESCRIPTION OF THE PREFERRED EMBODIMENT OF THE INVENTION

Figure 1:
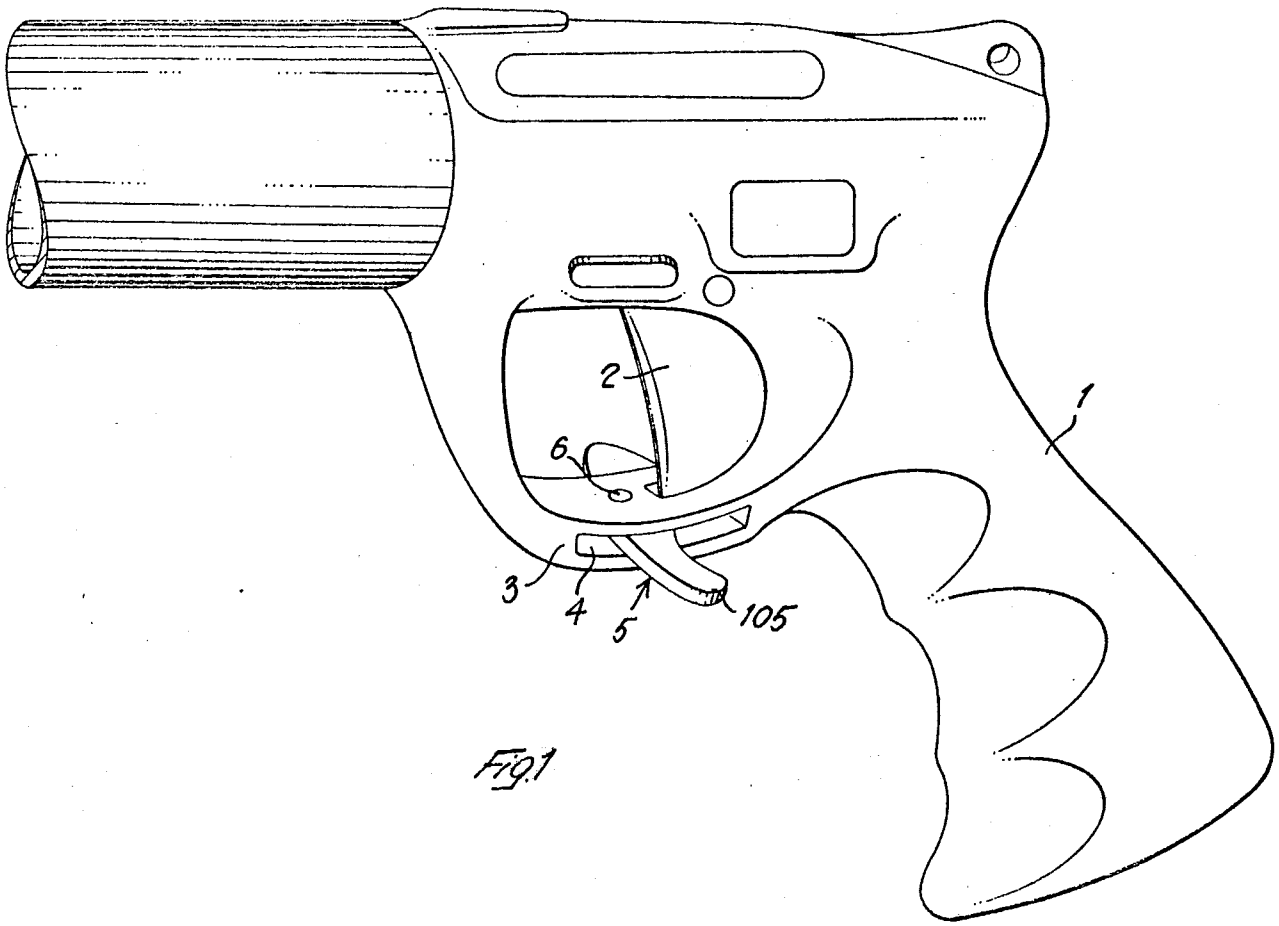
FIG. 1 is a sideview of the handgrip of an underwater gun provided with the line releasing device according to the invention.

With reference to the drawings, and with particular reference to FIG. 1, numeral 1 denotes the handgrip of an underwater gun. This handgrip is of the conventional pistol type, and is provided with a trigger 2 and a trigger guard 3. The trigger guard 3 is provided, in its horizontal portion, with a transversal through slot 4 in which the dog member 5 is inserted and fulcrumed, by means of a vertical pin 6, to the trigger guard 3 so as to rock into a horizontal plane inside the slot 4.

Figure 3:
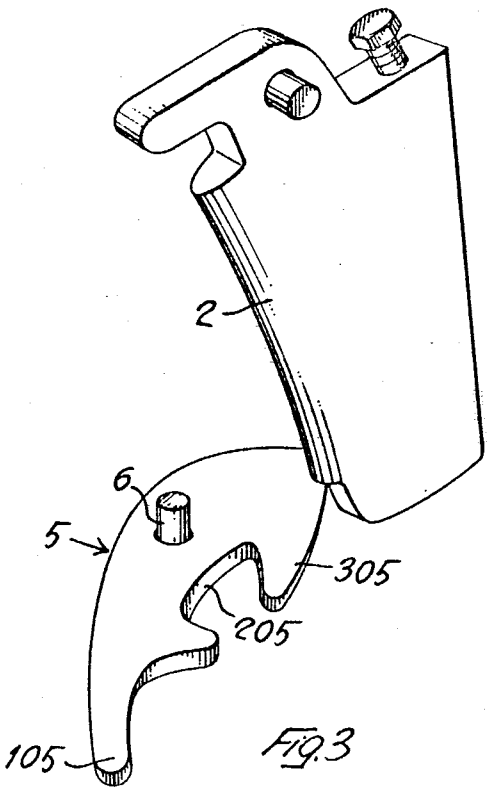
FIG. 3 is a view similar to FIG. 2, with the trigger and the dog member in their position just after the line release.
Figure 2:
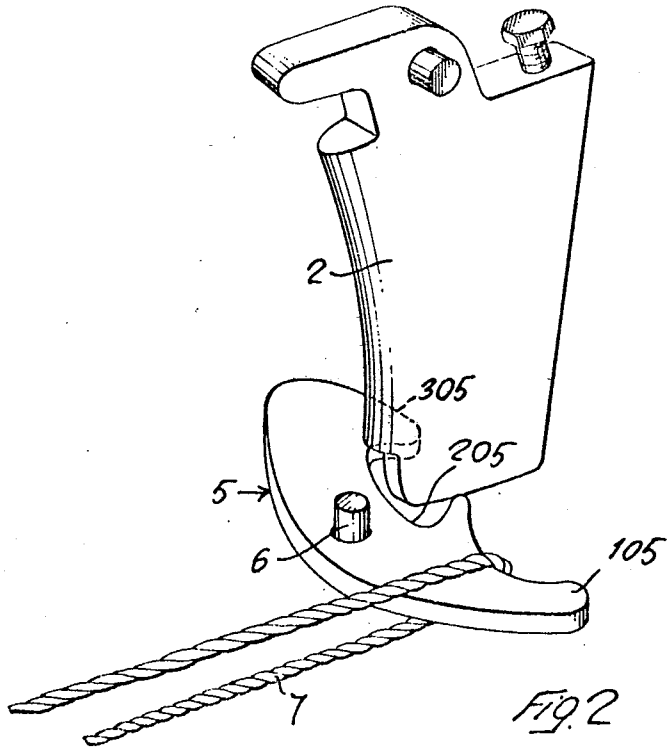
FIG. 2 is a diagrammatic view showing the trigger and the line retaining dog in their mutual positions when the line releasing device is in line-retaining position.

As best shown in FIGS. 2 and 3, the dog 5 is provided at one end with an extension or arm 105 to which the line 7 may be releasably secured by hooking it around said arm. The dog 5 is further provided, in its central portion, with a notch 205 which may accomodate the front edge of the lower end of the trigger 2. At its end

305 opposite to arm 105, the dog 5 is suitably cam shaped in order to cooperate with the trigger, after each operation of same, to automatically return the dog 5 into its cock position (position of FIG. 2) by effect of the push exerted through the trigger 2 by the trigger spring (not shown), until the front edge of the trigger 2 snaps into notch 205 of the dog, thus keeping it steadily into the cock or line retaining position of FIG. 2.

The operation of the described device will be evident. By operating the trigger 2, the dog 5 is released just when the trigger edge comes out of the notch 205, thus allowing the dog 5 to rock around its pin 6 into line releasing position. The back movement of the trigger, controlled by the trigger spring, brings the dog 5 back to the line fastening position.

The main advantage of the device according to the invention resides in the fact that the strength of release is substantially constant notwithstanding the force caused by the stress applied by the line to the line releasing device. The trigger position is not influenced by the line stress.

I claim:

1. In an underwater speargun comprising a barrel which is adapted to have a line tethered spear projected therefrom, said barrel having at one end thereof a pistol grip with a trigger guard and a spring biased trigger in said guard, means for connecting a spear tethering line to said pistol grip, a spear tethering means for holding said line taut and releasing the same upon squeezing of said trigger, said line holding and releasing means comprising a dog pivoted at its central portion on said guard about a vertical axis positioned in front of said trigger and said dog being positioned in a plane that is transverse to said axis, said central portion having a notch formed therein which faces and receives said trigger therein, one end of said dog projecting laterally beyond said guard and being adapted to have a spear tethering line looped thereon when said trigger is in said notch, and upon the squeezing of said trigger permits the projection of a tethered spear from said barrel after the tripper is withdrawn from said notch and the dog is released for pivotal movement about said axis to release a spear tethered line.

2. In an improved line holding and releasing means as in claim 1, wherein the other end of said dog has a curved cam portion thereon which is engaged by said trigger when a spear is released to pivot said dog in an opposite direction back to a cocked position with respect to said trigger whereby said trigger re-enters said notch.

3. In an improved line holding and releasing means as in claim 2, wherein said dog is disposed in a horizontal slot formed in said guard, a pin in said slot pivotally mounts said dog therein, said dog notch being disposed in said slot, a vertical slot formed in said guard above said horizontal slot, said vertical slot intersecting said horizontal slot and having the lower end of said trigger extending therethrough into said horizontal slot for cooperation with the dog notch therein.

* * * * *